US005528802A

United States Patent [19]

Akashi

[11] Patent Number: 5,528,802

[45] Date of Patent: Jun. 25, 1996

[54] LOCKABLE SLIDER FOR SLIDE FASTENERS

[75] Inventor: Shunji Akashi, Kurobe, Japan

[73] Assignee: YKK Corporation, Tokyo, Japan

[21] Appl. No.: 500,497

[22] Filed: Jul. 11, 1995

[30] Foreign Application Priority Data

Jul. 11, 1994 [JP] Japan ..... 6-158566

[51] Int. Cl.[6] ..... A44B 19/00

[52] U.S. Cl. ..... 24/420; 24/421; 24/418

[58] Field of Search ..... 24/420, 421, 422, 24/418, 425, 429; 70/68, 57

[56] References Cited

U.S. PATENT DOCUMENTS 2,261,132 11/1941 Poux .
2,599,536 6/1952 Backer ..... 24/421
3,262,172 7/1966 Scheuerman ..... 24/421
5,031,286 7/1991 Kedzierski ..... 24/421
5,167,052 12/1992 Aoki et al. .

*Primary Examiner*—Victor N. Sakran
*Attorney, Agent, or Firm*—Hill, Steadman & Simpson

[57] ABSTRACT

A lockable slider for a slide fastener includes a locking key composed of a lock bar, a grip lever provided at one end thereof so as to extend radially outwardly therefrom and a locking prong provided at an intermediate position thereof so as to extend radially outwardly therefrom and substantially normally to the grip lever. The locking key is disposed within the C-shaped wall and between the confronting walls both provided on the upper surface of the upper wing of the slider. The locking key is rotatable on its own axis between a first position in which to bring the locking prong through the aperture into the guide channel and a second position in which to retract the locking prong through the aperture from the guide channel.

7 Claims, 9 Drawing Sheets

LOCKABLE SLIDER FOR SLIDE FASTENERS

BACKGROUND OF THE INVENTION

1. Field of the Invention

The present invention relates to a lockable slider for slide fasteners wherein the slider can be readily switched between a locked disposition and an unlocked disposition by manipulating a simple locking mechanism.

2. Description of the Related Art

Several sliders of the type mentioned above are known, an example of which is a lockable slider as disclosed for instance in U.S. Pat. No. 5,167,052 and another example is a lockable slider as taught in U.S. Pat. No. 2,261,132.

The slider shown in the first-named application comprises a slider body having a neck portion provided at the front end thereof and having a channel to reciprocate rows of coupling elements, a locking member having a locking prong formed at its one end and adapted for oscillation to bring the locking prong into and out of the coupling element reciprocation channel, and a rotatable actuating roller or integral actuating lever movably disposed on the neck portion and connected cooperatively to the locking member, the actuating lever projecting outwardly for manipulation from outside of the slider. The locking member employed in such a prior art slider is structurally complicated and literally tedious to manipulate. Furthermore, this locking member cannot attain reliable locking or unlocking operation of the slider relative to the coupling element rows. Because of the disposition of the locking member on the slider body, moreover, the slider is rather bulky and less aesthetic.

In the last-named patent, the slider is composed of a slider body having therein a longitudinally disposed channel for slidably guiding rows of coupling elements, a pull member pivoted to the slider body, locking means disposed on the pull tab and adapted to move into and out of the guide channel by a swinging movement of the pull tab, cam means on the pull member having a plurality of flat surfaces defining unlocked and locked positions of the pull member and the locking member, and a leaf spring carried by the slider body and engaging the cam means and cooperating with the flat surfaces thereof. The leaf spring yieldingly urges the pull member to the nearest of a plurality of predetermined positions defined by the flat surfaces of the cam means from positions between those predetermined positions, and yieldingly maintains the pull member in such predetermined positions for locking and unlocking the slider. This known slider is arranged such that the locking member integral with the pull member is retracted from the guide channel by pulling the pull member in one or the other direction and is brought into engagement in between the coupling elements by flipping the pull member flat against the slider body. Since the locking and unlocking operation of the slider can be done by simple manipulation of the pull tab, the slider tends to accidentally release from its locked position and hence would not warrant application for security purposes.

SUMMARY OF THE INVENTION

With the foregoing drawbacks of the prior art in view, it is an object of the present invention to provide a lockable slider for a slide fastener that has a structurally simple locking mechanism, and can therefore be readily switched between locked and unlocked positions by manipulating the locking mechanism.

It is another object of the present invention to provide a slide that has a locking mechanism to prevent the slider from accidentally coming out of either locked position or unlocked position, even when the pull tab is being pulled severely in any direction. This is due to the pull tab and the locking key being formed independently from each other.

According to the present invention, there is provided a lockable slider for a slide fastener including a pair of interengaging element rows to be coupled and uncoupled by the lockable slider, said lockable slider comprising: (a) a slider body including an upper wing and a lower wing joined at one end of the slider body by a connecting neck so as to define therebetween a generally Y-shaped guide channel; a pair of confronting walls and a substantially C-shaped wall provided on the upper surface of the upper wing and separated from each other longitudinally of the slider body, the C-shaped wall being open toward the confronting walls, the confronting walls and the opposed side walls of the C-shaped wall being arranged substantially in parallel to each other, the upper wing having a through aperture formed therethrough to communicate with the Y-shaped guide channel and positioned in a region defined by the C-shaped wall and the confronting walls but partly deviated from the region; (b) a pull tab having a axle provided on its one end; (c) an attachment cover attached to respective upper sides of the confronting walls and the C-shaped wall with the axle of the pull tab arranged between the confronting walls and the C-shaped wall; and (d) a locking key including a lock bar, a grip lever provided at one end thereof so as to extend radially outwardly therefrom and a locking prong provided at an intermediate position thereof so as to extend radially outwardly therefrom and substantially normally to the grip lever; the locking key being disposed within the C-shaped wall and between the confronting walls; with the locking bar deviated relative to the longitudinal axis of the slider body toward the through aperture, the locking key being rotatable on its own axis between a first position in which to bring the locking prong through the aperture into the guide channel and a second position in which to retract the locking prong through the aperture from the guide channel.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION OF THE DRAWINGS

DETAILED DESCRIPTION

Figure 1:
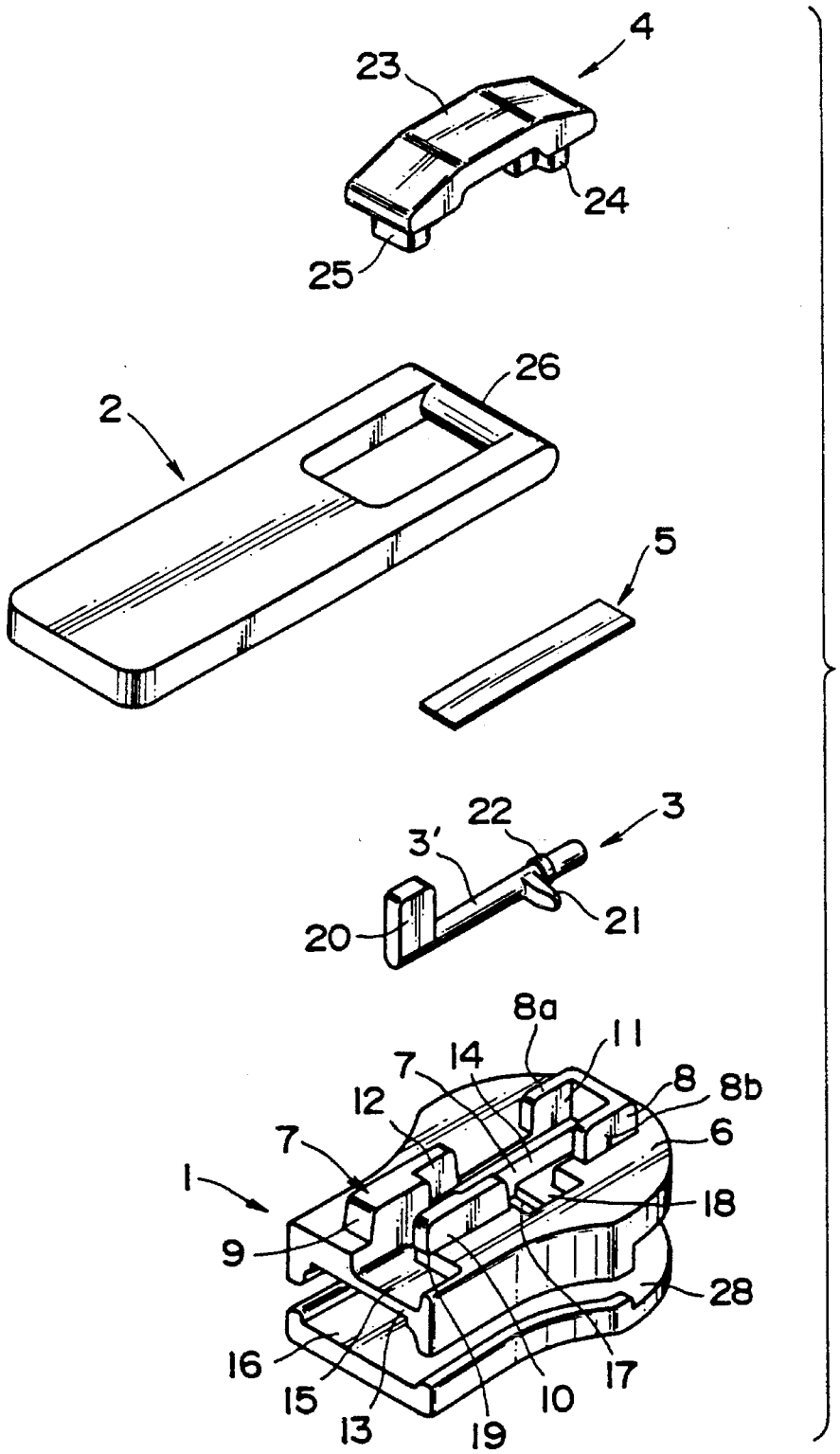
FIG. 1 is an exploded and view of the slider according to a first embodiment of the present invention.

Six embodiments of this invention will be described in detail in conjunction with the drawings.

Although the present invention relates to a lockable slider which is a part of a slide fastener, a slide fastener will be generally described before giving the specific and detailed description of a lockable slider according to the present invention. A slide fastener broadly comprises a pair of fastener stringers including a pair of fastener tapes having two rows of coupling elements provided one on each inner marginal edge thereof, although these parts are not shown in the drawings except for the lockable slider and the rows of coupling elements and a lockable slider reciprocally mounted on the two rows of coupling elements to couple and uncoupled the coupling element rows.

FIG. 1 shows a lockable slider according to a first embodiment of the present invention. The lockable slider broadly comprises five parts: a slider body 1, a pull tab 2, a locking key 3, an attachment cover 4 and a resilient plate 5.

Figure 3:
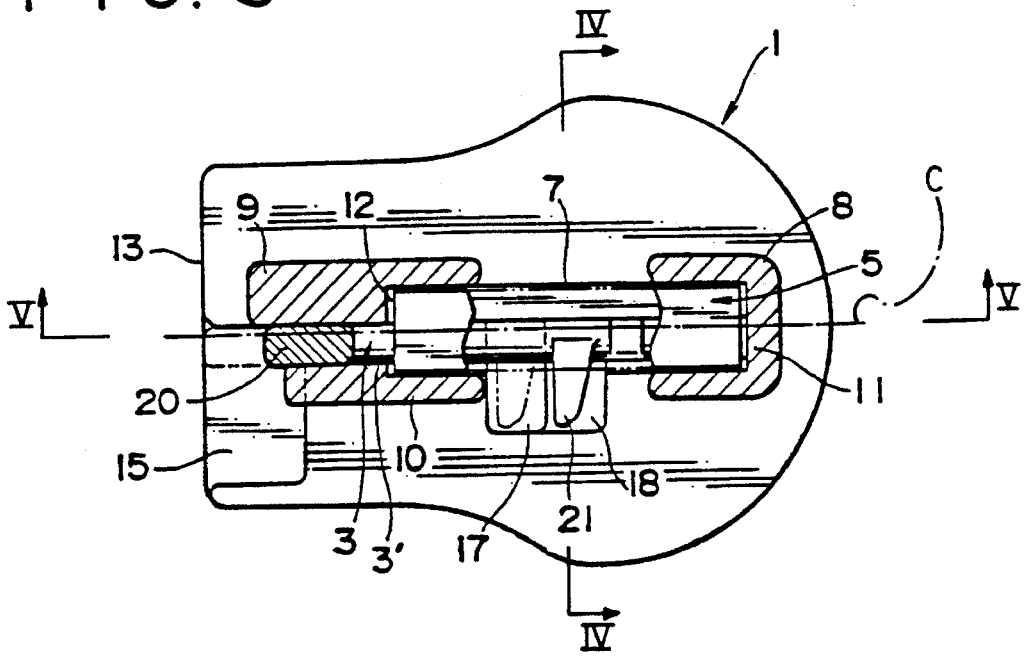
FIG. 3 is a plan view of a slider body, partly cut away to show that a locking key is movable between a first position and a second position.
Figure 5:
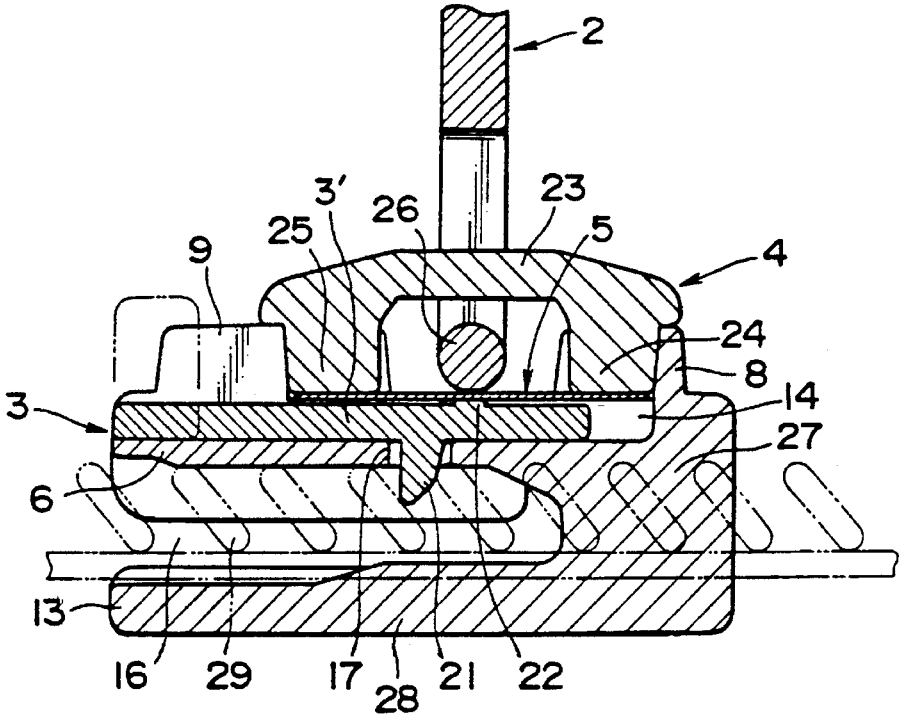
FIG. 5 is a longitudinal cross-sectional view of the lockable slider of FIG. 1.

The slider body 1 includes an upper wing 6 and a lower wing 28 joined at one end or a flared front end of the slider body 1 by a connecting neck 27 so as to define threbetween a generally Y-shaped guide channel 16 for passage of the coupling element rows 29 therethrough, as better shown in FIG. 5. As shown in FIGS. 1 and 3, a substantially C-shaped wall 8 is provided on the upper surface of the upper wing 6 adjacent to the flared front end. A pair of confronting walls 9, 10 are provided on the upper surface of the upper wing 6 adjacent to the contracted rear end. The C-shaped wall 8 and the confronting walls 9, 10 are disposed centrally of the longitudinal axis of the slider body 1 and are separated from each other longitudinally of the slider body 1. The C-shaped wall 8 being open toward the confronting walls 9, 10. The confronting walls 9, 10 and opposed side walls 8*a*, 8*b* of the C-shaped wall 8 are arranged in parallel to each other. The C-shaped wall 8 defines a space 11 therein. The confronting wall 9 is longer than the confronting wall 10 and extends beyond the rear end of the latter. The confronting walls 9, 10 have their opposed sides cut away at the front ends to define therebetween a space 12 which is as wide as the space 11. An elongated groove 14 is formed in the upper surface of the upper wing 6 so as to extend from the C-shaped wall 8 and through between the confronting walls 9, 10 and terminates in the contracted rear end of the slider body 1. The elongated groove 14 is deviated relative to the longitudinal axis C of the slider body 1 toward a through aperture 17 later described, as better shown in FIG. 3. A widened and offset recess 15 is formed mergingly with the rear end of the elongated groove 14 and is offset toward the confronting wall 10. Furthermore, the upper wing 6 has a through aperture 17 formed therethrough so as to communicate with the Y-shaped guide channel 16. The through aperture 17 merges with the intermediate portion of the elongated groove 14 and is positioned on the front end of the shorter confronting wall 10. In other words, the through aperture 17 is positioned in a region 7 defined by the C-shaped wall 8 and the confronting walls 9, 10 but deviated from the region 7 downward as viewed in FIG. 3. An intermediate recess 18 is formed on the upper surface of the upper wing 6 and merges with the aperture 17. The recess 18 is positioned close to the C-shaped wall 8. The rear end of the shorter confronting wall 10 is undercut to provide an overhanging engaging projection 19 overlying the rear offset recess 15.

A locking key 3 includes a lock bar 3' which is thin enough to be fitted within the elongated groove 14. A grip lever 20 is provided at one end of the lock bar 3' so as to extend radially outwardly therefrom. A locking prong 21 is provided on the lock bar 3' at its intermediate position so as to extend radially outwardly therefrom and substantially normally to the grip lever 20. The locking key 3 further has a cam 22 on its locking bar 3' adjacent to the locking prong 21. The cam 22 projects in the same direction as the grip lever 20 extends and in the opposite direction as the locking prong 21 projects.

As better shown in FIG. 5, an attachment cover 4 is of a bridge shape. The attachment cover 4 includes an cover plate 23 and a pair of lugs 24, 25 provided at the opposed ends thereof. The lugs 24 and 25 are adapted to be fitted into the spaces 11 and 12, respectively, as shown in FIG. 1. A pull tab 2 may be of any shape, but preferably has an axle 26 provided at its one end, as shown in FIG. 1. A resilient plate 5 is composed of a plate spring and is of such a size as to cause one end to be fitted into the space 11 and the other end to be fitted into the space 12, as shown in FIG. 3. The lockable slider may dispense with the cam 22 and the resilient plate 5. In this event, the locking key 3 is held within the elongated groove 14 directly by the lugs 24 and 25 of the attachment cover 4 so that the locking key 3 is rotatable on its own axis and slidable along the elongated groove 14.

Figure 4:
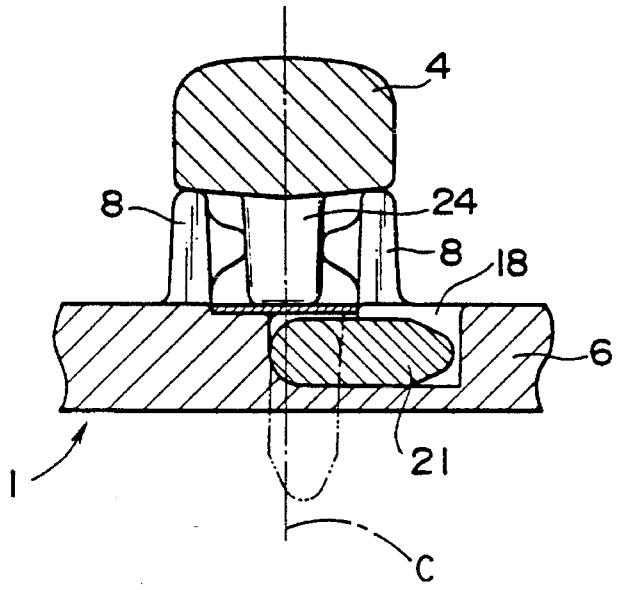
FIG. 4 is a cross-sectional view of the locking key and its associated parts of the slider of FIG. 1.

Referring to the assembly of the lockable slider according to this embodiment of the present invention: First, the lock bar 3' of the locking key 3 is fitted into the elongated groove 14 in the upper surface of the upper wing 6. At this instance, the lock bar 3' is deviated relative to the longitudinal axis C of the slider body 1 toward the through aperture 17. The grip lever 20 is disposed upright between the confronting walls 9, 10, while the locking prong 21 lies over the aperture 17. Then, the resilient plate 5 is placed between the C-shaped wall 8 and the confronting walls 9, 10 with one end fitted into the space 11 and the other end fitted in the space 12. Then, the pull tab 2 is placed on the upper wing 6 with the axle 26 interposed between the C-shaped wall 8 and the confronting walls 9, 10. Finally, the attachment cover 4 is placed on the C-shaped wall 8 and the confronting walls 9, 10 with the lug 24 fitted into the space 11 and the lug 25 fitted in the space 12. At this instance, the axle 26 of the pull tab 2 is held in situ by the cover plate 23 of the attachment cover 4. Then, as shown in FIG. 4, the confronting walls 9, 10 and the C-shaped wall 8 are clenched against the lugs 24, 25, respectively so that the attachment cover 4 is secured to the confronting walls 9, 10 and the C-shaped wall 8 with the locking key 3 being both slidable and rotatable on the slider body 1. The locking key 3 is rotatable on its own axis between a first position in which to cause the locking prong 21 move through the aperture 17 into the guide channel 16 and a second position in which to cause the clocking prong 21 to retract through the aperture 17 from the guide channel 16. Furthermore, the locking bar 3' is slidable within the elongated groove 14 between a position where the locking prong 21 comes into registry with the intermediate recess 18 and another position where the grip lever 20 comes into registry with the offset recess 15 and the locking prong 21 comes into registry with the through aperture 17.

Figure 2:
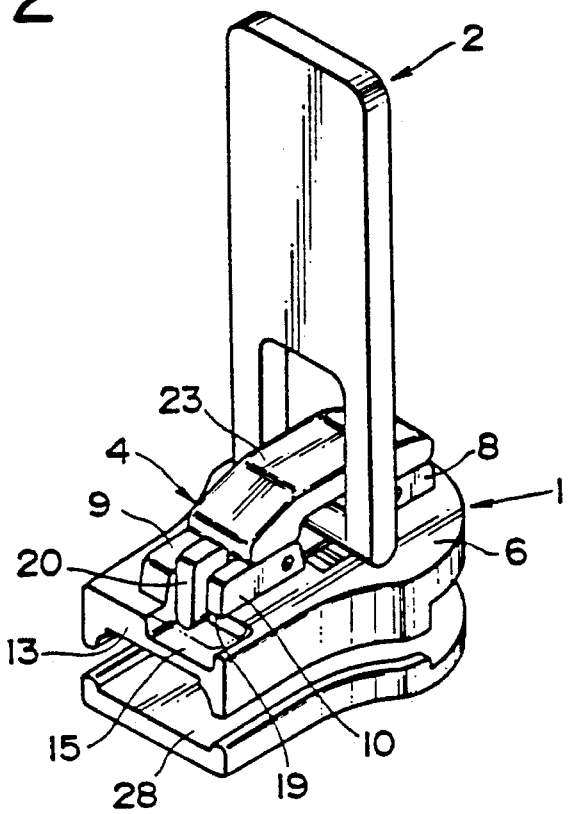
FIG. 2 is a perspective view of the slider of FIG. 1.

In order to lock the slider to the fastener element rows, the grip lever 20 is gripped and the locking key 3 is pulled down from the forward position indicated by the solid lines in FIG. 3 to the rear position indicated by phantom lines to thus bring the locking prong 21 into registry with the through aperture 17. Then, the grip lever 20 is rotated clockwise as viewed in FIG. 1 against the resiliency of the resilient plate 5 so as to rest flat against the offset recess 15 as shown by phantom lines in FIG. 2 so that the locking prong 21 similarly rotates and comes through the through aperture 17 into locking engagement with the fastener element rows 29 in the Y-shaped guide channel 16. Then, the grip lever 20 is pushed slightly forward to come into engagement with the overhanging engaging projection 19 so that the lockable slider is completely locked to the fastener element rows. In this way, however hard the pull tab 2 is pulled, the slider will not move.

In order to resume reciprocation of the slider, the grip lever 20 is pulled rearward out of engagement with the overhanging engaging projection 19. Then, the grip lever 20 is rotated into the upright position as shown by solid lines in FIG. 2, so that the locking prong 21 similarly rotates and comes out of engagement with the fastener element rows 29. Then, the grip lever 20 is pushed forward to come between the confronting walls 9, 10 so that the locking prong 21 moves forward into registry with the intermediate recess 18. With the locking key 3 kept in unlocked position, the slider is freely movable along the fastener element rows 29 by manipulating the pull tab 2. Whether in the locked position or in the unlocked position, the locking key 3 is maintained in that position unless intentionally switched, due to the combined actions of the resilient plate 5 and the cam 22 of the locking key 3.

Figure 6:
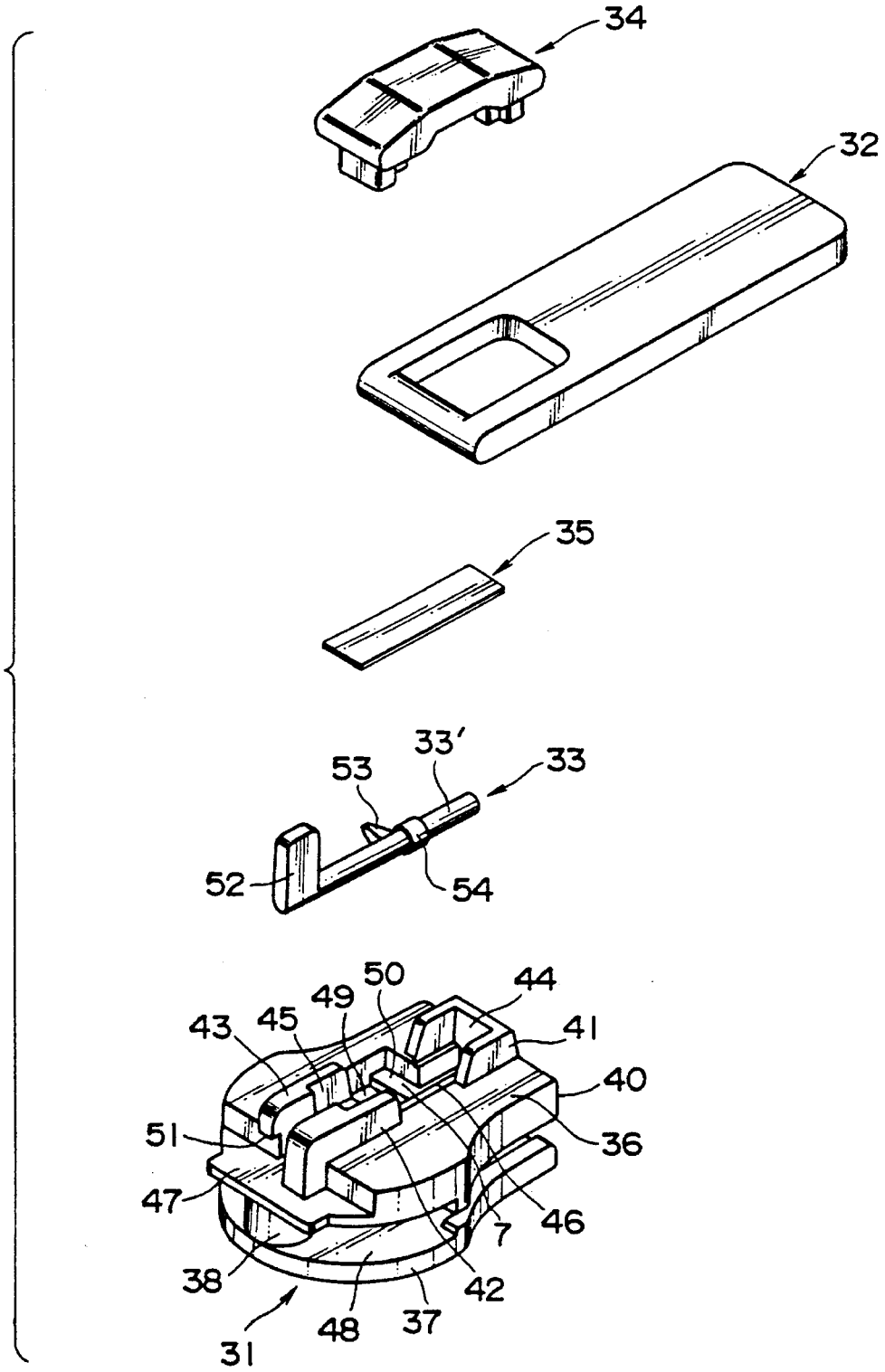
FIG. 6 is an exploded, perspective view of a slider according to a second embodiment of the present invention.

FIG. 6 shows a lockable slider according to the second embodiment of the present invention. This lockable slider differs from the lockable slider according to the first embodiment of the invention, in that the arrangement of a C-shaped wall 41 and a pair of confronting walls 42, 43 is the other way around and correspondingly the locking key 33 is oriented in the opposite direction. This slider also comprises five parts, that is, a slider body 31, a pull tab 32, a locking key 33 and an attachment cover 34 and a resilient plate 35. The slider body 31 comprises an upper wing 36 and a lower wing 37 joined by a connecting neck 38 at the flared front end thereof. Conversely to the first embodiment, according to the second embodiment, the C-shaped wall 41 is disposed at the contracted end of the slider body 31 and the two confronting walls 42, 43 are disposed adjacent to the flared front end. The confronting wall 42 is longer than the confronting wall 43, and extends forward beyond the front end of the confronting wall 43. The C-shaped wall 41 defines therein a space 44. The confronting walls 42, 43 have their respective opposed sides cut-away at the rear end to define therebetween a space 45, which is substantially as wide as the space 44.

An elongated groove 46 is formed in an upper surface of the upper wing 36 so as to extend from the C-shaped wall 41 through between the confronting walls 42, 43 and terminates in a widened recess 15 provided on the connecting neck 38 of the slider body 31. A through aperture 47 is formed mergingly with the intermediate portion of the elongated groove 46. The through aperture 49 communicates with the Y-shaped guide channel 48. An intermediate recess 50 is formed mergingly with the through aperture 49. The confronting wall 43 has its front end undercut to provide an overhanging engaging projection 51 lying over the widened recess 47.

Similarly to the preceding embodiment, the locking key 33 has a lock bar 33', a grip lever 52 provided on one end of the lock bar 33' so as to extend radially outwardly therebetween and a locking prong 53 provided on an intermediate portion of the lock bar 33' so as to extend radially outward therefrom. The locking prong 53 of this slider projects from the lock bar 33' in the opposite direction to the locking prong 21 in the slider according to the preceding embodiment. A cam 54 is provided on the lock bar 33' adjacent to the locking prong 53. The pull tab 32, the attachment cover 34 and the resilient plate 35 of this lockable slider are of the same shape as the corresponding parts of the lockable slider according to the preceding embodiment. The lockable slider according to the second embodiment is assembled in similar way to the slider according to the first embodiment.

In order to lock the slider to the fastener element rows 29, the grip lever 52 is gripped and the locking key 33 is pulled down from the rearward position to the forward position to thus bring the locking prong 53 into registry with the through aperture 49. Then, the grip lever 52 is rotated counter-clockwise as viewed in FIG. 6—opposite to the preceding embodiment—against the resiliency of the resilient plate 35 so as to rest flat against the widened recess 47 so that the locking prong 53 similarly rotates and comes through the through aperture 49 into locking engagement with the fastener element rows 29 in the Y-shaped guide channel 48. Then, the grip lever 52 is pushed slightly rearward to come into engagement with the overhanging engaging projection 51 so that the lockable slider is completely locked to the fastener element rows 29. In this way, however hard the pull tab 32 is pulled, the slider will not move.

In order to resume reciprocation of the slider, the grip lever 52 is pulled forward out of engagement with the overhanging engaging projection 51. Then, the grip lever 52 is rotated clockwise into the upright position, so that the locking prong 53 similarly rotates and comes out of engagement with the fastener element rows 29. Then, the grip, lever 52 is pushed rearward to come between the confronting walls 42, 43 so that the locking prong 53 moves rearward into registry with the intermediate recess 50. With the locking key 33 kept in unlocked position, the slider is freely movable along the fastener element rows 29 by manipulating the pull tab 32. Whether in the locked position or in the unlocked position, the locking key 33 is maintained in that position unless intentionally switched, due to the combined actions of the resilient plate 35 and the cam 54 of the locking key 33.

Figure 7:
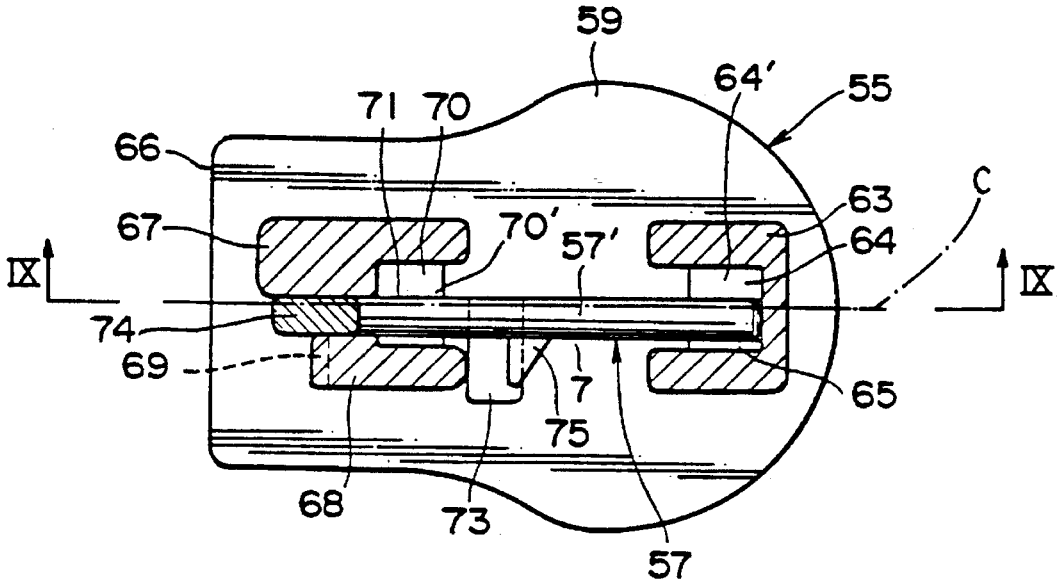
FIG. 7 is a plan view, partly in cross-section, of a slider according to a third embodiment of the present invention.
Figure 8:
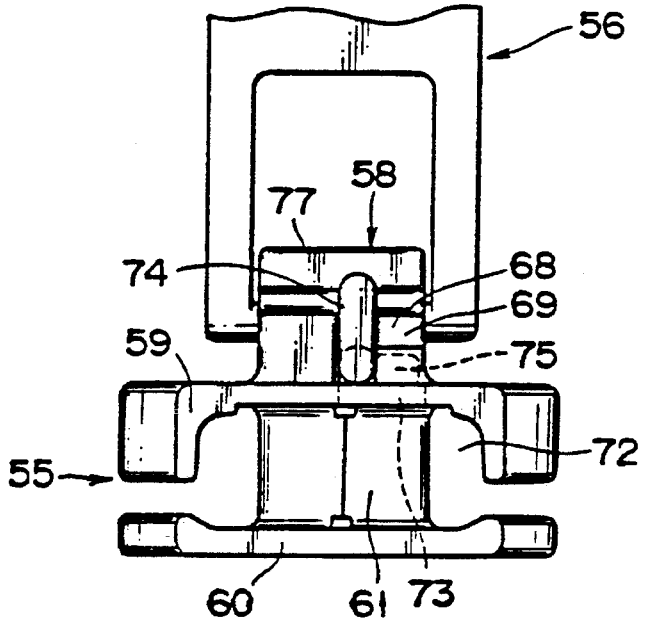
FIG. 8 is a rear view of the slider of FIG. 7.
Figure 9:
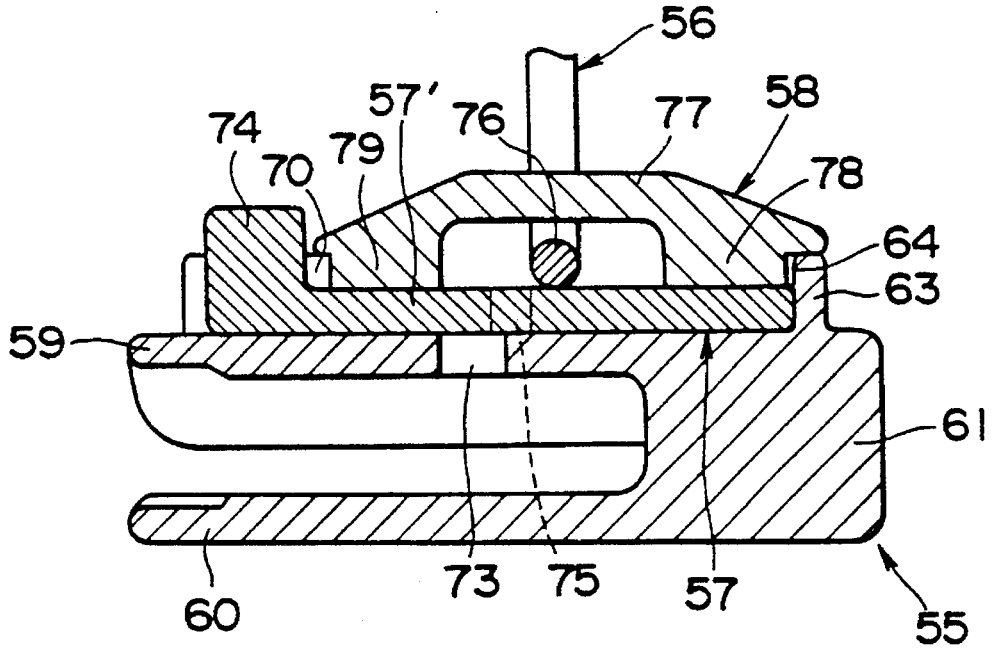
FIG. 9 is a longitudinal cross-sectional view of the slider of FIG. 7.

FIGS. 7 through 9 shows the third embodiment of the present invention. The lockable slider according to the third embodiment comprises four parts: a slider body 55, a pull tab 56, a locking key 57 and an attachment cover 58. A C-shaped wall 63 is provided on the upper surface of the upper wing 59 adjacent to the flared front end. A pair of confronting walls 67, 68 are provided on the upper surface of the upper wing 59 adjacent to the contracted rear end. The confronting wall 67 is longer than the confronting wall 68, and extends rearward beyond the rear end of the confronting wall 68. The confronting walls 67, 68 are separated from each other by such a distance as to permit the lock bar 57' of the locking key 57 to fit comfortably therebetween. A land 64' is provided in the space 64 defined by the C-shaped wall 63 and another land 70' is provided within the space 70 defined between the opposed sides of the confronting walls 67, 68 at their front ends. A groove 65 is formed in the land 64' and another groove 71 is formed in the land 70', both grooves 65, 71 being in alignment with each other. The bottoms of the aligned grooves 65 and 71 are both flush with the upper surface of the lapper wing 59. The grooves 65, 71 are of adequate size to receive the lock bar 57' of the locking key 57. The rear end of the shorter confronting wall 68 is undercut to thus provide an overhanging engaging projection 69 overlying the upper surface of the upper wing 59. A rectangular aperture 73 is formed through the upper wing 59 so as to communicate with the Y-shaped guide channel 72. The rectangular aperture 73 is positioned on the front end of the shorter confronting wall 68.

The locking key 57 includes the lock bar 57' which is thin enough to be fitted within the two aligned grooves 65, 71 and between the confronting wall 67, 69. A grip lever 74 is provided at one end of the lock bar 57' so as to extend radially outwardly therefrom. A locking prong 75 is provided on the lock bar 57' at its intermediate position so as to extend radially outwardly therefrom and substantially normally to the grip lever 74.

As shown in FIG. 9, an attachment cover 58 is of a bridge shape. The attachment cover 58 includes an cover plate 77 and a pair of lugs 78, 79 provided at the opposed ends thereof. The lugs 78 and 79 are adapted to be fitted into the spaces 64 and 70, respectively.

Referring to the assembly of the lockable slider according to this embodiment of the present invention: As shown in FIG. 7, first, the front end of the lock bar 33' of the locking key 33 is fitted into the groove 65 in the space 64. The rear end of the lock bar 33' is fitted into the groove 71 and between the confronting walls 67, 68 with the grip lever 74 disposed upright as shown in FIG. 7. Then, as shown in FIG. 7, the pull tab 56 is placed on the upper wing 59 of the slider with the axle 76 interposed between the C-shaped wall 63 and the confronting walls 68, 69. Finally, the attachment cover 58 is placed on the C-shaped wall 63 and the confronting walls 68, 69 with the lugs 78, 79 fitted into the spaces 64, 70, respectively. At this instance, the axle 76 of the pull tab 56 is held in situ by and under the cover plate 77 of the attachment cover 58. Then, the confronting walls 67, 68 and the C-shaped wall 63 are clenched against the lugs 79, 78, respectively so that the attachment cover 4 is attached to the confronting walls 67, 68 and the C-shaped wall 63 with the locking key 57 kept both slidable and rotatable on the upper wing 59 of the slider body 1.

Although, according to this embodiment, the slider is devoid of a resilient plate and the locking key 57 is devoid of a cam, the locking key 57 may have a cam and a resilient plate provided beneath the lugs 78, 79 of the attachment cover 58 so as to come into pressing engagement with a cam of the locking key 57.

Figure 10:
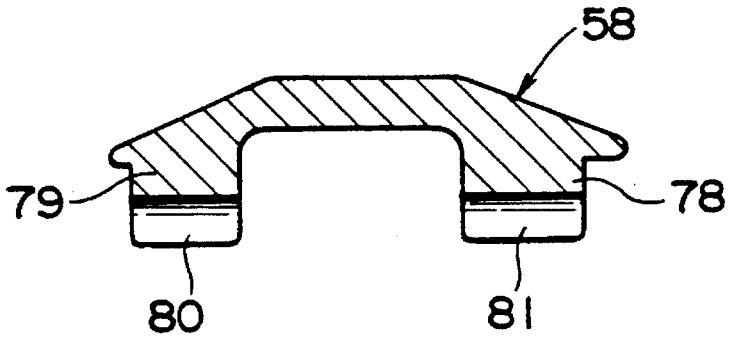
FIG. 10 is a longitudinal cross-sectional view of an attachment cover of a slider according to a fourth embodiment of the present invention.
Figure 11:
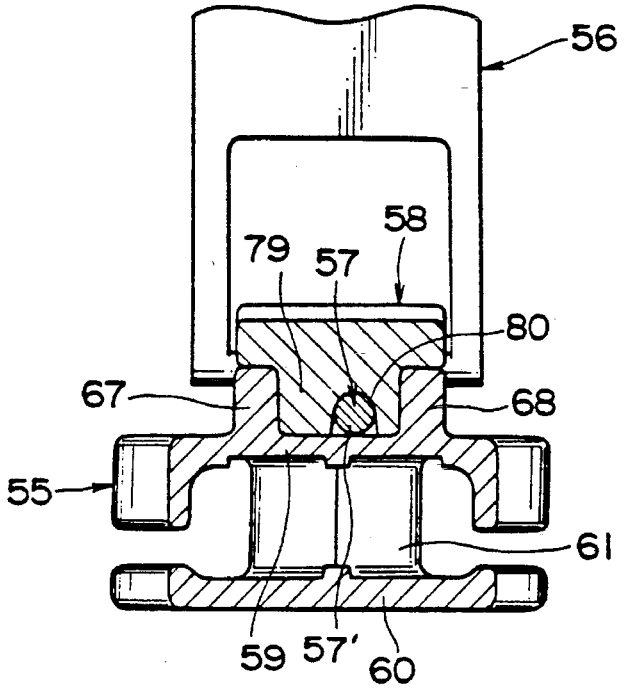
FIG. 11 is a partly cut-away cross-sectional view of the slider according to the fourth embodiment of the present invention.

FIGS. 10 and 11 shows a lockable slider according to a fourth embodiment of this invention. This lockable slider is the same as the preceding embodiment except for the following. The opposed sides of the C-shaped wall 63 are separated from each other by a slightly greater distance than in the preceding embodiment. No land nor groove are formed in the C-shaped wall 63 or between the confronting walls 67, 68. Instead, the opposed lugs 78, 79 of the attachment cover 58 have aligned grooves 81, 80 formed in their respective lower sides. The lock bar 57' of the locking key 57 is fitted through the grooves 80 and 81. Due to this construction, the height of the lockable slider is advantageously reduced.

In order to lock the slider to the fastener element rows 29, the grip lever 74 is gripped and the locking key 57 is pulled down from the forward position to the rearward position to thus bring the locking prong 75 into registry with the through aperture 73. Then, the grip lever 74 is rotated clockwise as viewed in FIG. 8 so as to rest flat against the upper surface of the upper wing 59 as shown by phantom lines in FIG. 8 so that the locking prong 75 similarly rotates and comes through the through aperture 73 into locking engagement with the fastener element rows 29 in the Y-shaped guide channel 72. Then, the grip lever 74 is pushed slightly forward to come into engagement with the overhanging engaging projection 69 so that the lockable slider is completely locked to the fastener element rows 29. In this way, however hard the pull tab 56 is pulled, the lockable slider will not move.

In order to resume reciprocation of the slider, the grip lever 74 is pulled rearward out of engagement with the overhanging engaging projection 69. Then, the grip lever 74 is rotated counter-clockwise as viewed in FIG. 8 from the lying position as shown by phantom lines in FIG. 8 into the upright position as shown by solid lines in FIG. 8, so that the locking prong 75 similarly rotates and comes out of engagement with the fastener element rows 29. Then, the grip lever 74 is pushed forward to come between the confronting walls 67, 68 so that the locking prong 75 moves forward out of registry with the through aperture 73. With the locking key kept in unlocked position, the lockable slider is freely movable along the fastener element rows 29 by manipulating the pull tab 56.

Figure 12:
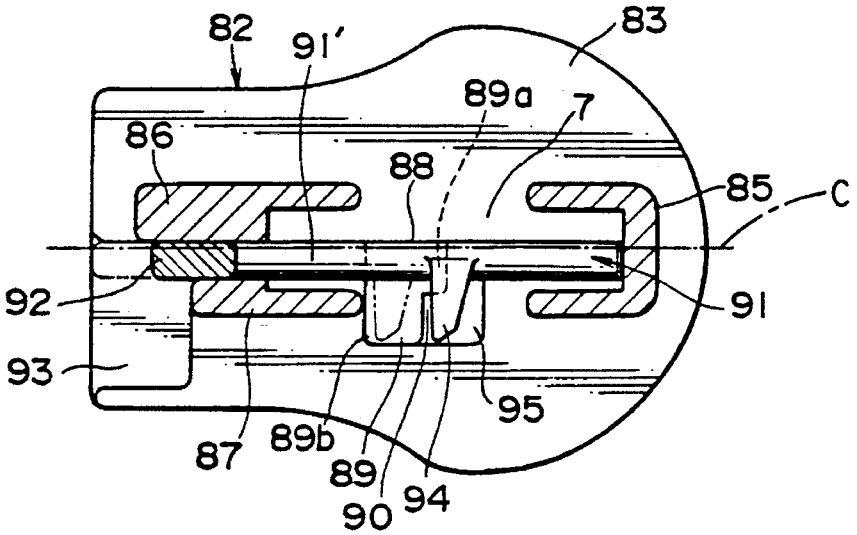
FIG. 12 is a plan view, partly cross-sectional, of a slider of a fifth embodiment of the present invention.

FIG. 12 shows a lockable slider according to the fifth embodiment of this invention. A C-shaped wall 85 is provided on the upper surface of the upper wing 83 adjacent to the flared front end. A pair of confronting walls 86, 87 are provided on the upper surface of the upper wing 83 adjacent to the contracted rear end. An elongated groove 88 is formed in the upper surface of the upper wing 83 so as to extend from the C-shaped wall 87 through between the confronting walls 86, 87 and terminate in the contracted rear end of the slider. A L-shaped through aperture 89 is formed through the upper wing 83 at the front end of the shorter confronting wall 87. A shorter leg **89*a* of the L-shaped aperture 89 merges with the intermediate portion of the elongated groove 88. A locking ledge 90 is defined by the shorter leg 89*a* and a longer leg 89*b* at an inner comer in which they meet. The locking ledge 90 is recessed in its upper surface to thus provide an intermediate recess 95. The recess 95 is adapted to permit the locking prong 94 to rest thereupon. The locking prong 94 is adapted to come into locking engagement with the locking ledge 90**.

In order to lock the slider to the fastener element rows 29, the grip lever 92 is gripped and the locking key 91 is pulled down fully until the locking prong 94 comes into abutting engagement with the front end of the shorter confronting wall 87 to thus bring the locking prong 94 into registry with the through aperture 17. Then, the grip lever 92 is rotated so as to rest flat against the offset recess 93 so that the locking prong 94 similarly rotates and comes through the through aperture 89 into locking engagement with the fastener element rows 29 in the Y-shaped guide channel. Then, the grip lever 92 is pushed slightly forward to bring the locking prong 94 into engagement with the locking ledge 90 so that the lockable slider is completely locked to the fastener element rows 29. In this way, however hard the pull tab is pulled, the slider will not move.

In order to resume reciprocation of the slider, the grip lever 92 is pulled slightly rearward to bring the locking prong 94 out of engagement with the locking ledge 90 and into registry with the through aperture 89. Then, the grip lever 92 is rotated into the upright position, so that the locking prong 94 similarly rotates and comes out of engagement with the fastener element rows 29. Then, the grip lever 94 is pushed forward to come between the confronting walls 86, 87 so that the locking prong 94 moves forward into registry with the intermediate recess 95. With the locking key 91 kept in unlocked position, the slider is freely movable along the fastener element rows 29 by manipulating the pull tab.

Figure 13:
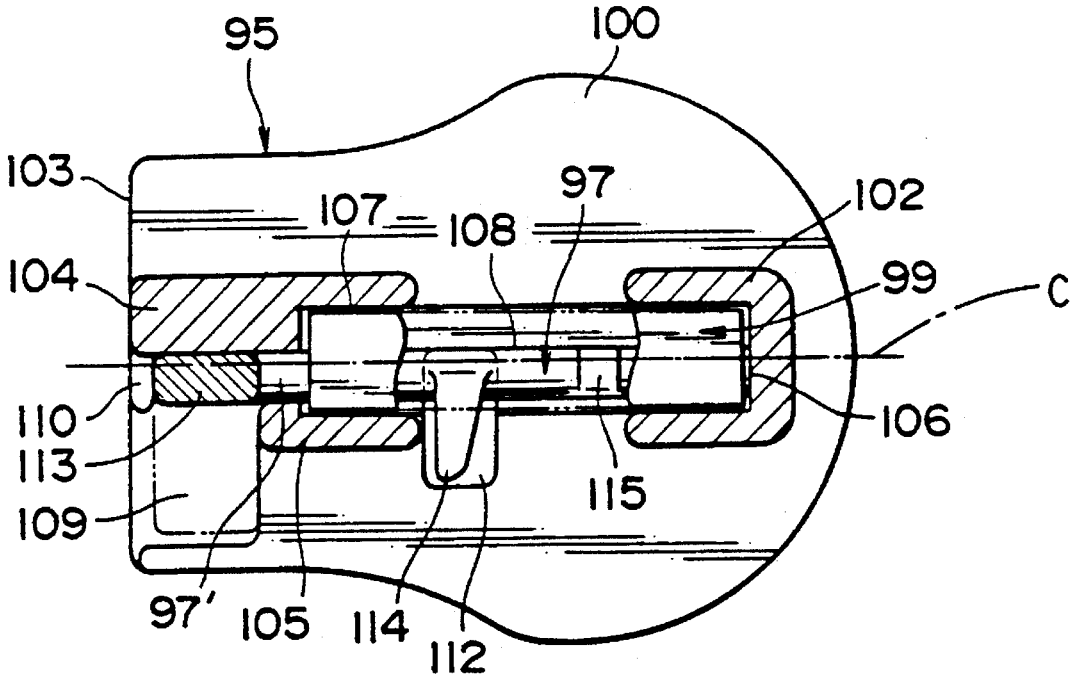
FIG. 13 is a plan view, partly cross-sectional, of a slider of a sixth embodiment of the present invention.
Figure 14:
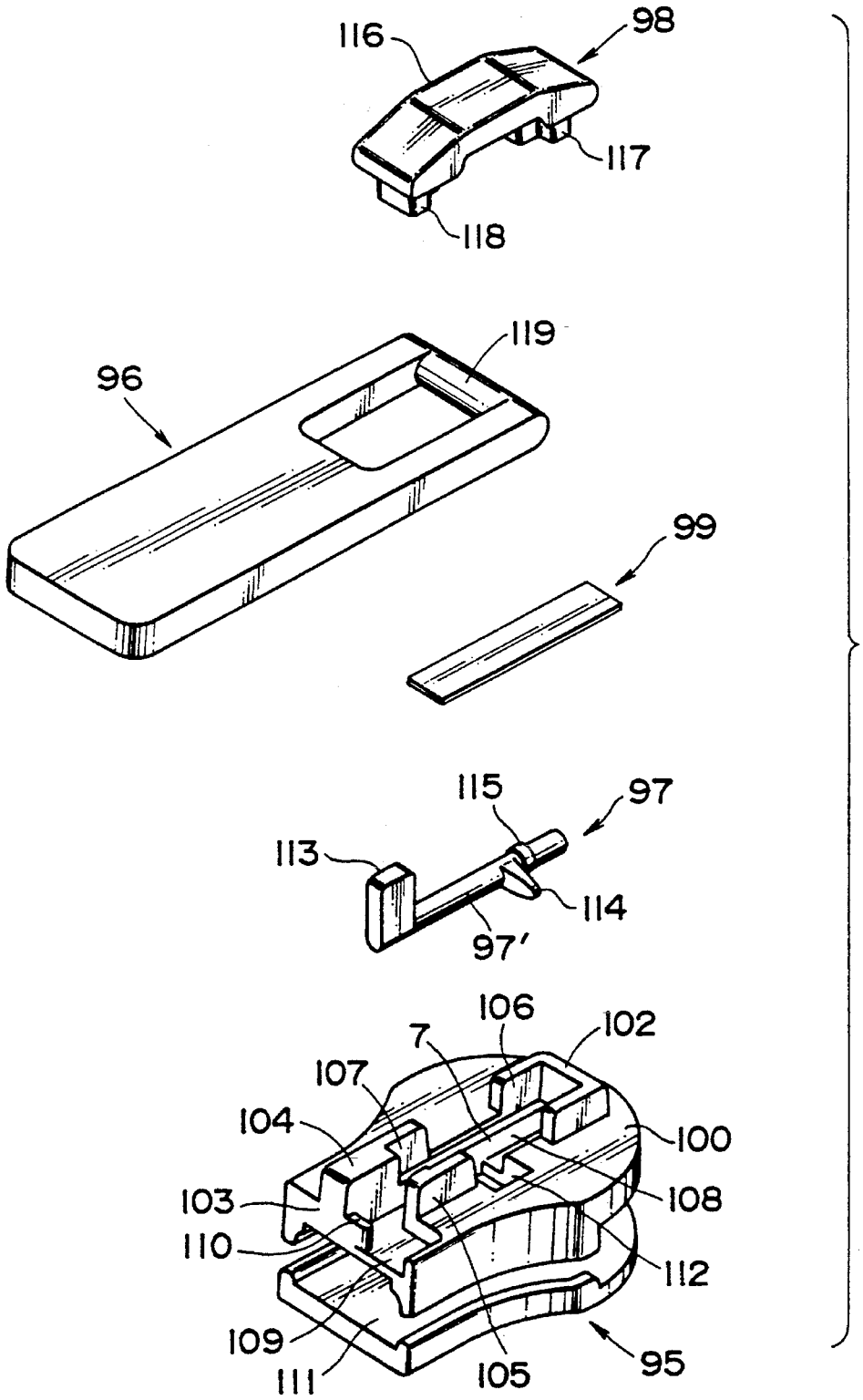
FIG. 14 is an exploded perspective view of a slider of FIG. 13.

FIGS. 13 and 14 shows a lockable slider according a sixth embodiment of the present invention. In this slider, a locking key 97 is not slidable on the slider body but only rotatable on its own axis. This lockable slider also comprises five parts, that is, a slider body 95, a pull tab 96, the locking key 97, an attachment cover 98 and a resilient plate 99. A C-shaped wall 102 is provided on the upper surface of the upper wing 100 adjacent to the flared front end. Two confronting walls 104, 105 are provided on the upper surface of the upper wing 100 adjacent to the contracted rear end 103. The confronting wall 104 is longer than the confronting wall 105. The confronting wall 104 extends rearward beyond the rear end 103 of the shorter confronting wall 105 and terminates in the rear edge of the slider body. The C-shaped wall 102 defines therein a space 106. The confronting walls 104, 105 have their opposed sides cut-away at the front end to provide a space 107 therebetween. Both spaces 106, 107 have the same widths and are in alignment with each other.

Furthermore, an elongated groove 108 is formed in the upper surface of the upper wing 100 so as to extend from the C-shaped wall 102 and between the confronting walls 104, 105, and terminates in a protuberant lug 110 provided on the rear end of the slider body 95. An offset recess 109 is formed on the upper surface of the upper wing 100 at its rear end so as to merge with the elongated groove 108. A through aperture 112 is formed through the upper wing 100 and is disposed at the front end of the shorter confronting wall 105.

A locking key 97 includes a lock bar 97' which is thin enough to be fitted within the elongated groove 108. A grip lever 113 is provided at one end of the lock bar 97' so as to extend radially outwardly therefrom. A locking prong 114 is provided on the lock bar 97' at its intermediate position so as to extend radially outward therefrom and substantially normally to the grip lever 113. The locking key 97 further has a cam 115 on its locking bar 97' adjacent to the locking prong 114. The cam 115 projects in the same direction as the grip lever 113 extends and in the opposite direction as the locking prong 114 projects.

As better shown in FIG. 14, an attachment cover 98 is of a bridge shape. The attachment cover 98 includes an cover plate 116 and a pair of lugs 117, 118 provided at the opposed ends thereof. The lugs 117 and 118 are adapted to be fitted into the spaces 106 and 107, respectively, as shown in FIG. 14.

In order to assemble this lockable slider, the locking key 97 is fitted into the elongated groove 108 with the grip lever 113 abutted against the inner side of the longer confronting wall 104 and with the locking prong 114 being in registry with the through aperture 112. Then, a resilient plate 99 is placed on the locking key 97 with one end fitted into the space 106 and the other end fitted into the other space 107. Then, the axle 119 of a pull tab 96 is placed over the resilient plate 99 between the C-shaped wall 102 and the confronting walls 104, 105. Then, the attachment cover 98 is placed on the C-shaped wall 102 and the confronting walls 104, 105 with the lugs 117, 118 fitted into the spaces 106, 107, respectively. Eventually, the C-shaped wall 102 and the confronting walls 104, 105 are clenched against the lugs 117, 118, respectively, of the attachment cover 98, so that the attachment cover 98 is secured to the C-shaped wall 102 and the corresponding walls 104, 105, with the locking key 97 being rotatable on its own axis in the elongated groove 108. As shown in FIG. 13, when the grip lever 109 is rotated, the front edge of the grip lever 109 slides on the rear end of the shorter confronting wall 105.

In order to lock the slider to the fastener element rows 29, the grip lever 113 is gripped and is rotated against the resiliency of the resilient plate 99 so as to rest flat against the offset recess 109 as shown by phantom lines in FIG. 13 so that the locking prong 114 similarly rotates and comes through the through aperture 112 into locking engagement with the fastener element rows in the Y-shaped guide channel.

In order to resume reciprocation of the slider, the grip lever 113 is rotated into the upright position against the resiliency of the resilient plate 97, so that the locking prong 114 similarly rotates and comes out of engagement with the fastener element rows 29. With the locking key 97 in the unlocked position, the slider is freely movable along the fastener element rows 29 by manipulating the pull tab 2.

The following advantages are afforded by the specific forms and constructions of the slider according to the invention herein described and illustrated.

The slider of the invention has a locking key composed of a lock bar adapted to fit within an elongated groove formed in an upper surface of an upper wing of the slider, a grip lever provided at one end of the lock bar and extending radially outwardly therefrom, and a locking prong provided on the lock bar at its intermediate position and extending radially outwardly and substantially normal to the grip lever. The upper wing has a through aperture formed therethrough and merges with the intermediate position of the elongated groove. The aperture communicates with a Y-shaped channel for the passage of coupling element rows. An attachment cover is secured to the confronting walls and a C-shaped wall on the upper wing with the locking key being slidable and rotatable on a slider body of the slider. Advantageously, the provision of the locking key independently of a pull tab contributes greatly to ready and convenient manipulation of that locking key. The grip lever on the locking bar serves to attain reliable switching of the slider between locked and unlocked positions. The locking key is simple in structure as compared to conventional locking mechanisms, smooth to manipulate and free from failure. Because the locking key is disposed in the C-shaped wall and between the confronting walls with the locking bar deviated toward the through aperture, the locking prong is brought through the aperture into the guide channel and then between the coupling elements at any desired position and with the utmost reliability.

The locking key according to the invention is slidable and rotatable on the upper surface of the slider body. This means that the locking prong can be brought, without the need of excess force, into engagement or disengagement with the coupling elements. The grip lever is disposed to engage with an overhanging engaging projection formed on the confronting walls, and the locking prong is disposed to engage with an engaging ledger defined by the through aperture, thereby preventing the slider from becoming unintentionally moved on and along the coupling element rows; that is, manipulation of the locking key by hand is required to open the associated slide fastener. Thus, the slider of the invention is suitable for security use.

An offset or widened recess is formed mergingly with a rear end of the elongated groove, and an intermediate recess is formed on the upper surface of the upper wing. The locking prong lies within the intermediate recess when the locking key assumes a position in which to retract the locking prong from the guide channel. The grip lever lies within the offset or widened recess when the locking key assumes a position in which to bring the locking prong into the guide channel. With such structure, the slider of the invention is of reduced height and hence visually pleasing as compared to conventional counterparts of the lockable type.

A resilient plate is provided between the attachment cover and the locking key so as to normally urge the locking key toward the upper wing. With the construction, least manipulation of the locking key allows the same to be smoothly slidable and rotatable on the upper surface of the slider body. Furthermore, a cam is provided on the locking bar and adjacent to the locking prong, the cam being in pressing engagement with the resilient plate. The cam ensures that the locking key can be slided and rotated with greater accuracy.

Obviously, the skilled person would realize that various modifications and variations of the present invention are possible in the light of the above teaching. It is therefore to be understood that within the scope of the appended claims the invention may be practiced otherwise than as specifically described, and that the invention is not limited to the embodiments described above in detail.

What is claimed is:

1. A lockable slider for a slide fastener including a pair of interengaging element rows to be coupled and uncoupled by the lockable slider, said lockable slider comprising:

(a) a slider body including an upper wing and a lower wing joined at one end of the slider body by a connecting neck so as to define therebetween a generally Y-shaped guide channel; a pair of confronting walls and a substantially C-shaped wall provided on the upper surface of the upper wing and separated from each other longitudinally of the slider body, the C-shaped wall being open toward the confronting walls, the confronting walls and the opposed side walls of the C-shaped wall being arranged substantially in parallel to each other, the upper wing having a through aperture formed therethrough to communicate with the Y-shaped guide channel and positioned in a region defined by the C-shaped wall and the confronting walls but partly deviated from the region;

(b) a pull tab having a axle provided on its one end;

(c) an attachment cover attached to respective upper sides of the confronting walls and the C-shaped wall with the axle of the pull tab arranged between the confronting walls; and the C-shaped wall; and (d) a locking key including a lock bar, a grip lever provided at one end thereof so as to extend radially outwardly therefrom and a locking prong provided at an intermediate position thereof so as to extend radially outwardly therefrom and substantially normally to the grip lever; the locking key being disposed within the C-shaped wall and between the confronting walls with the locking bar deviated relative to the longitudinal axis of the slider body toward the through aperture, the locking key being rotatable on its own axis between a first position in which to bring the locking prong through the aperture into the guide channel and a second position in which to retract the locking prong through the aperture from the guide channel.

2. A lockable slider according to claim 1, wherein the locking bar is slidable along its own axis so as to selectively bring the locking prong into and out of registry with the through aperture.

3. A locking slider according to claim 1, wherein one confronting wall is undercut at its one end to provide an overhanging engaging projection which is engageable with the grip lever when the locking key assumes the first position.

4. A locking slider according to claim 1, wherein the through aperture is shaped substantially L-shaped, an engaging ledge being defined by a shorter leg and a longer leg of the L-shaped aperture at its corner for engagement with the locking prong of the locking key.

5. A locking slider according to claim 1, the upper wing having an elongated groove formed in the upper surface so as to extend from the C-shaped wall between the confronting walls, and terminate in a widened recess formed on one end of the upper wing, the elongated groove merging with the through aperture at its intermediate position, the upper wing further including an intermediate recess formed mergingly with the through aperture and with the elongated groove, the locking bar being slidable within the elongated groove between a position where the locking prong comes into registry with the intermediate recess and another position where the grip lever comes into registry with the widened recess and the locking prong comes into registry with the through aperture.

6. A lockable slider according to claim 1, wherein a resilient plate is provided between the attachment cover 4 and the locking key so as to normally urge the locking key toward the upper wing.

7. A locking slider according to claim 1, wherein the locking key has a cam on its locking bar adjacent to the locking prong, the cam being in pressing engagement with the resilient plate.

* * * * *